US011628491B2

(12) United States Patent
Zhu et al.

(10) Patent No.: US 11,628,491 B2
(45) Date of Patent: Apr. 18, 2023

(54) COPPER BILLET HORIZONTAL CONTINUOUS CASTING APPARATUS AND PROCESS WITH A VERTICAL SHAFT FURNACE FOR SMELTING

(71) Applicant: ZHEJIANG HAILIANG CO., LTD., Zhejiang (CN)

(72) Inventors: Zhangquan Zhu, Zhejiang (CN); Xuelong Zhao, Zhejiang (CN); Weimin Ma, Zhejiang (CN); Zhiqiang Dong, Zhejiang (CN); Lirong Jiang, Zhejiang (CN); Jianping Feng, Zhejiang (CN); Guang Zhou, Zhejiang (CN); Zhenming Wang, Zhejiang (CN); Zhongzhan Zhang, Zhejiang (CN); Zhen Fan, Zhejiang (CN); Jie Zhao, Zhejiang (CN); Yue Li, Zhejiang (CN); Zhefeng Ruan, Zhejiang (CN); Liyong Wang, Zhejiang (CN); Jia He, Zhejiang (CN); Fuliang He, Zhejiang (CN); Yina Pan, Zhejiang (CN); Shili Ouyang, Zhejiang (CN); Wencai Peng, Zhejiang (CN); Liyun Tian, Zhejiang (CN); Jingke Yu, Zhejiang (CN); Yonglong Fu, Zhejiang (CN); Xibin Lin, Zhejiang (CN); Lusen Huang, Zhejiang (CN); Xiaoyong He, Zhejiang (CN)

(73) Assignee: ZHEJIANG HAILIANG CO., LTD., Zhejiang (CN)

( * ) Notice: Subject to any disclaimer, the term of this patent is extended or adjusted under 35 U.S.C. 154(b) by 0 days.

(21) Appl. No.: 17/700,525

(22) Filed: Mar. 22, 2022

(65) Prior Publication Data

US 2023/0011680 A1 Jan. 12, 2023

(30) Foreign Application Priority Data

Jul. 7, 2021 (CN) ..... 202110765754.6

(51) Int. Cl.
*B22D 11/00* (2006.01)
*B22D 11/045* (2006.01)
*B22D 11/117* (2006.01)

(52) U.S. Cl.
CPC ..... *B22D 11/004* (2013.01); *B22D 11/045* (2013.01); *B22D 11/117* (2013.01)

(58) Field of Classification Search
CPC ..... B22D 11/00; B22D 11/004; B22D 11/045; B22D 11/117
(Continued)

(56) References Cited

U.S. PATENT DOCUMENTS 6,589,474 B1 * 7/2003 Park et al. ..... C22B 9/023 266/236

* cited by examiner

*Primary Examiner* — Kevin P Kerns
(74) *Attorney, Agent, or Firm* — JCIPRNET

(57) ABSTRACT

The present invention provides a copper billet horizontal continuous casting apparatus with a vertical shaft furnace for smelting and a corresponding process. The copper billet horizontal continuous casting apparatus with a vertical shaft furnace for smelting includes: a vertical shaft, a refining furnace, a mixing furnace, a holding furnace, and a continuous casting furnace; wherein the refining furnace includes a furnace body, and a gas flushing device disposed beneath the furnace body, a gas flushing brick is provided at the chamber bottom wall of the furnace body; a gas inlet device is provided on the vertical shaft furnace; the vertical shaft furnace further includes a detecting device and an adjusting device which are connected with the air inlet device.

20 Claims, 5 Drawing Sheets

(58) Field of Classification Search
USPC ..... 164/440, 490
See application file for complete search history.

COPPER BILLET HORIZONTAL CONTINUOUS CASTING APPARATUS AND PROCESS WITH A VERTICAL SHAFT FURNACE FOR SMELTING

CROSS-REFERENCE TO RELATED APPLICATION

The present application is based on and claims the priority benefits of China application No. 202110765754.6, filed on Jul. 7, 2021. The entirety of the above-mentioned patent application is hereby incorporated by reference herein and made a part of this specification.

BACKGROUND

Technical Field

The disclosure relates to tube blank manufacturing equipment, and more particularly relates to a copper billet horizontal continuous casting apparatus and process with a vertical shaft furnace for smelting.

Description of Related Art

Of the first metals used by humans, copper is an important strategic material. Copper tubes are mainly applied to air-conditioning and refrigeration, architecture and decoration, shipping and marine engineering. About 75% copper tubes are applied to the refrigeration industry.

A conventional manufacturing process for air-conditioning/refrigeration-purpose copper tubes goes like this: melting copper using two sets of 2.3 t/h electric furnaces, horizontal continuous casting of billets to draw 2 to 5 strands in total per time, planetarily rolling repeatedly strand by strand, and going through procedures including middle-speed/low-speed combined drawing, inverted vertical drawing machine, induction annealing, inner thread forming, multi-round winding, and multi-stand annealing; however, transfer of copper tubes during the fabrication process still need manual manipulation of handling equipment such as handling carts. The manually involved process has a low work efficiency, a long production cycle, a low production line throughput, and a high investment with low returns; meanwhile, to increase the throughput, multiple production lines are needed, causing a large footprint, high energy consumption, high carbon emission, and environment unfriendliness.

SUMMARY

To overcome the above and other drawbacks in conventional technologies, the disclosure provides a copper billet horizontal continuous casting apparatus with a vertical shaft furnace for smelting, which enables simultaneous casting of 7 strands of billets, with improved throughput and reduced production cycle.

Embodiments of the disclosure provide:

a copper billet horizontal continuous casting apparatus with a vertical shaft furnace for smelting, comprising: the vertical shaft furnace for melting copper; and a refining furnace for refining liquid copper; and a mixing furnace connected with the vertical shaft furnace and the refining furnace, for mixing the liquid copper and phosphorous copper, which has a phosphorous copper charging port, a phosphorous copper charger being connected at the phosphorous copper charging port; and a holding furnace connected with the refining furnace, for continued slag removal; and a continuous casting furnace connected with the holding furnace, for simultaneously casting multiple strands of billets; wherein the refining furnace comprises a furnace body and a gas flushing device disposed beneath the furnace body, a gas flushing brick being disposed at a chamber bottom wall of the furnace body, the gas flushing device blowing an inert gas and/or a reducing gas into the furnace body through the gas flushing brick, a gas inlet device being provided on the vertical shaft furnace for introducing a mixed gas including air and a fuel gas into the vertical shaft furnace, and a detecting device and an adjusting device being further provided on the vertical shaft furnace, the detecting device and the adjusting device being connected with the gas inlet device, wherein the detecting device is configured for detecting a proportion between components in the mixed gas so as to control the adjusting device to adjust the proportion between the components in the mixed gas, thereby maintaining a reducing atmosphere in the vertical shaft furnace.

In an embodiment, the phosphorous copper charger comprises a hopper, and a delivery passageway connected with the phosphorous copper charging port, wherein a rotary bowl feeder having a plurality of phosphorous copper holding zones is provided between the hopper and the delivery passageway.

In an embodiment, the rotary bowl feeder comprises a first fixed bowl, a second fixed bowl, and a rotary bowl rotatably mounted between the first fixed bowl and the second fixed bowl, a feeding port connected with the hopper being provided on the first fixed bowl, a delivery port connected with the delivery passageway being provided on the second fixed bowl, wherein the plurality of phosphorous copper holding zones are arranged on the rotary bowl in a rectangular array.

In an embodiment, each phosphorous copper holding zone is provided with a weighing appliance, and an electromagnetic switch for controlling the phosphorous copper to enter the phosphorous copper holding zones is disposed beneath the hopper.

In an embodiment, a plurality of lines of baffles arrayed in an upper-lower spaced manner are provided in the mixing furnace to form a torturous liquid copper passageway.

In an embodiment, a first baffle is provided at a side in the refining furnace proximal to the holding furnace, the first baffle and an inner wall of the refining furnace enclosing a liquid copper output zone with a bottom opening, the liquid copper output zone being connected with a liquid copper inlet port of the holding furnace; and a second baffle is provided at a side in the refining furnace proximal to the mixing furnace, the second baffle and the inner wall of the refining furnace enclosing a liquid copper inlet zone with a bottom opening, the inert gas and/or the reducing gas being introduced to a center position of the bottom wall of the refining furnace.

In an embodiment, the gas inlet device comprises a plurality of gas inlets arranged along the vertical direction of the vertical shaft furnace, the gas inlets being connected with a fuel gas pipe and an air flushing pipe; the adjusting device comprises a gas inlet pipe connected with the gas inlets, and gas inlet valves disposed at the fuel gas pipe and the air flushing pipe; and the detecting device is connected with the gas inlet pipe.

In an embodiment, two holding furnaces are provided, the two holding furnaces being connected to the same refining furnace, the two holding furnaces being connected to one continuous casting furnace, respectively.

The disclosure further provides a copper billet horizontal continuous casting process with a vertical shaft furnace for smelting, which uses the copper billet horizontal continuous casting apparatus with a vertical shaft furnace described above, wherein the process comprises steps of: S10: introducing a mixed gas including air and a fuel gas into the vertical shaft furnace, and maintaining a reducing atmosphere in the vertical shaft furnace; S20: igniting the mixed gas to melt copper such that liquid copper flows into a mixing furnace, feeding, by a phosphorous copper charger, phosphorous copper blocks into the mixing furnace, delivering the liquid copper with molten phosphorous copper blocks into the refining furnace and meanwhile measuring weight of the refining furnace to obtain an incremental amount of liquid copper in the refining furnace within a unit time, and adjusting weight of the phosphorous copper charged from the phosphorous copper charger; S30: introducing an inert gas and/or a reducing gas to a bottom wall of the refining furnace to stir the liquid copper to accelerate slag removal; S40: delivering the liquid copper at a bottom wall of the refining furnace to a holding furnace, and adding a refining agent to the holding furnace to hold the liquid copper; S50: delivering the liquid copper in the holding furnace into a continuous casting furnace to produce billets.

In an embodiment, the maintaining the reducing atmosphere in the vertical shaft furnace comprises: detecting air flow and fuel gas flow introduced into the vertical shaft furnace, respectively; guiding a fraction of the mixed gas into a detecting zone, and igniting the fraction; detecting carbon monoxide concentration in a burnt gas; and in response to the carbon monoxide concentration being lower than a preset value, reducing the air flow.

Embodiments of the disclosure offer the following benefits.

The copper billet horizontal continuous casting apparatus with a vertical shaft furnace for smelting according to the disclosure uses the vertical shaft furnace for melting copper, which may produce a large amount of liquid copper to satisfy liquid copper demand of multi-strand casting (wherein multi-strand refers to simultaneously producing multiple strands of billets). Phosphorous copper is utilized to remove oxygen and impurities from the liquid copper. Through removal of oxygen and impurities with phosphorous copper and continued slag removal in the holding furnace, impurities may be further eliminated to yield high-quality liquid copper; meanwhile, the large amount of liquid copper enables smooth implementation of high-quality, multi-strand casting, which improves production speed of tube blanks and reduces production cycle.

The mixing furnace is used for mixing the phosphorous copper and the liquid copper so as to input the mixed liquid into the refining furnace. The gas flushing brick in the refining furnace has dense and very fine holes, such that the gas blown from the gas flushing device may be admitted into the furnace body through the gas to stir the liquid copper, allowing for sufficient mixing and reaction of the liquid copper and the phosphorous copper, which improves oxygen removal efficiency; in addition, automatic stirring is enabled without manual involvement, which further improves oxygen removal efficiency. Moreover, gas rises up in the liquid copper, which may quickly carry impurities to the surface of the liquid copper. Since the liquid copper has a larger specific gravity, the impurities carried to the surface by the gas are not further sunk; besides, the gas assumes a bubble form in the liquid copper; subjected to high temperature and high pressure inside the liquid copper, during rising of the bubbles in the liquid copper, the liquid copper may force the hydrogen dissolved in the liquid copper resulting from burning of the mixed gas into the bubbles, which may further reduce the hydrogen content in the liquid copper, thereby avoiding occurrence of bubbles on the tube blank surface due to precipitation of hydrogen in the casting and forming process.

The ignited mixed gas may heat the copper in the vertical shaft furnace. The air contains oxygen, while the main compositions of the fuel gas are hydrogen and carbon, which, when reacting with the oxygen, may produce carbon monoxide or carbon dioxide. The carbon monoxide has a good reducibility, which may react with the oxygen in the liquid copper, thereby achieving oxygen removal; by detecting the air flow and fuel gas flow, the proportion between the air and the fuel gas in the mixed gas may be obtained; atmosphere in the vertical shaft furnace after the mixed gas enters and reacts in the vertical shaft furnace may be inferred by calculating the proportion, wherein the proportion between the components in the mixed gas may be adjusted so as to change the atmosphere in the vertical shaft furnace, thereby maintaining a reducing atmosphere in the vertical shaft furnace. In this way, oxygen content in the liquid copper may be effectively achieved, and quality of the liquid copper may be improved.

Furthermore, the phosphorous copper charger is connected at the phosphorous copper charging port. The phosphorous copper charger comprises a hopper and a delivery passageway connected with the phosphorous copper charging port, wherein a rotary bowl feeder having a plurality of phosphorous copper holding zones is disposed between the hopper and the delivery passageway. The rotary bowl feeder may convey the phosphorous copper in the phosphorous copper holding zones to the phosphorous charging port via the delivery passageway during the process, and by adjusting the rotating speed of the rotary bowl feeder, duration of charging the phosphorous copper to the liquid copper and the amount of phosphorus copper fed into the phosphorous copper holding zones may be adjusted so as to change the proportion between the liquid copper and the phosphorous copper.

Furthermore, the rotary bowl feeder comprises a first fixed bowl, a second fixed bowl, and a rotary bowl rotatably mounted between the first fixed bowl and the second fixed bowl, a feeding port connected with the hopper being provided on the first fixed bowl, a delivery port connected with the delivery passageway being provided on the second fixed bowl, wherein the plurality of phosphorous copper holding zones are arranged on the rotary bowl in a rectangular array. When the rotary bowl rotates until the phosphorous copper holding zones lie beneath the feeding port, the phosphorous copper in the hopper may enter the phosphorous copper holding zones; after the rotary bowl rotates till the phosphorous copper holding zones lie at the delivery port, the phosphorous copper in the phosphorous copper holding zones may enter the delivery passageway; the orderly arrayed phosphorous copper holding zones may facilitate control of the rotating speed and rotating angle of the rotary bowl.

Furthermore, a weighing appliance is further provided in each phosphorous copper holding zone, and an electromagnetic switch for controlling the phosphorous copper to enter the phosphorous copper holding zones is disposed beneath the hopper. Since the phosphorous copper blocks are of non-uniform sizes, the amount of the phosphorous copper cannot be determined based on the space taken up by the phosphorous copper in the phosphorous copper holding zones, while the weighing appliance may measure the amount of phosphorous copper in each phosphorous copper holding zone, thereby controlling the amount of phosphorous copper to charge based on the liquid copper amount in the mixed furnace, which may avoid excessive phosphorous content in the liquid copper.

Furthermore, a plurality of lines of baffles arrayed in an upper-lower spaced manner are provided in the mixing furnace to form a torturous liquid copper passageway. Copper blocks contain many impurities, wherein part of the impurities are not molten in the liquid copper. When the liquid copper flows in the mixing furnace, it constantly contacts with the baffles; in addition, the liquid copper flow path assumes a shape of up-down fluctuation in the transverse direction, such that part of the impurities in the liquid copper can be blocked by the baffles from further flowing into the refining furnace. With cooperation between multiple baffles, impurities entering the refining furnace but not molten in the liquid copper are removed.

Furthermore, a first baffle is provided at a side in the refining furnace proximal to the holding furnace, the first baffle and an inner wall of the refining furnace enclosing a liquid copper output zone with a bottom opening, the liquid copper output zone being connected with a liquid copper inlet port of the holding furnace; and a second baffle is provided at a side in the refining furnace proximal to the mixing furnace, the second baffle and the inner wall of the refining furnace enclosing a liquid copper inlet zone with a bottom opening, the inert gas and/or the reducing gas being introduced to a center position of the bottom wall of the refining furnace. The liquid copper in the refining furnace further has impurities such as oxygen and hydrogen. The first baffle may directly block the liquid copper entering the refining furnace from the mixing furnace. The flowing liquid copper is first stirred by the gases for sufficient removal of impurities; therefore, the lower-layer liquid copper proximal to the holding furnace is relatively clean. To cast tube blanks with this fraction of liquid copper, quality of the tube blanks may be ensured. The second baffle may block the liquid copper entering the holding furnace from the refining furnace, preventing from directly flowing till beneath the liquid copper output zone; instead, the second baffle may buffer the liquid copper to ensure sufficient removal of the oxygen and impurities, thereby improving quality of the liquid copper.

Furthermore, the gas inlet device comprises a plurality of gas inlets arranged on the vertical shaft furnace along the vertical direction, the gas inlets being connected with a fuel gas pipe and an air flushing pipe; the adjusting device comprises a gas inlet pipe connected with the gas inlets and gas inlet valves disposed at the fuel gas pipe and the air flushing pipe; and the detecting device is connected with the gas inlet pipe. By providing the plurality of gas inlets, the mixed gas may be introduced to various portions in the vertical shaft furnace, which may ensure uniform temperature inside the vertical shaft furnace and improve smelting efficiency. The detecting device may access the mixed gas at the gas inlets via the gas inlet pipe to detect a proportion between components of the mixed gas. The gas inlet valves may adjust the flow of the fuel gas or the flow of air to maintain the mixed gas at an appropriate proportion between the components, thereby ensuring quality of the liquid copper.

Furthermore, two holding furnaces are provided, wherein the two holding furnaces are connected to a same refining furnace, and the two holding furnaces are connected to one continuous casting furnace, respectively. Since it takes certain time for each holding furnace to process the liquid copper, when one holding furnace is processing the liquid copper, the continuous casting furnace connected with the other holding furnace may carry out casting of tube blanks; after the casting of tube blanks is finished, the previous holding furnace also completes processing of the liquid copper; this enables continuous casting of tube blank casting. In this way, tube blanks can be produced non-intermittently.

The disclosure further provides a process for manufacturing billets using the copper billet horizontal continuous casting apparatus with a vertical shaft furnace for smelting as described above. The ignited mixed gas may heat the copper in the vertical shaft furnace, and maintaining a reducing atmosphere in the vertical shaft furnace to effectively reduce oxygen content in the liquid copper, thereby improving quality of the liquid copper. The phosphorous copper fed into the mixing furnace is melted and mixed with the liquid copper before entering the refining furnace. Introducing of the inert gas and/or the reducing gas into the refining furnace may stir the liquid copper through the gas, causing the liquid copper and the phosphorous copper to be sufficiently mixed and reacted, which improves oxygen removal efficiency and realizes automatic stirring without manual involvement. Moreover, the gases rise up in the liquid copper, which may quickly carry impurities to the surface of the liquid copper. Since the liquid copper has a larger specific gravity, the impurities carried to the surface by the gases are not further sunk; besides, the gases assume a bubble form in the liquid copper, such that subjected to high temperature and high pressure inside the liquid copper, when the bubbles are rising up in the liquid copper, the liquid copper may force the hydrogen dissolved in the liquid copper resulting from burning of the mixed gas into the bubbles, which may further reduce the hydrogen content in the liquid copper, thereby avoiding occurrence of bubbles on the tube blank surface due to precipitation of hydrogen during the casting and forming process. To reduce phosphorous content in the liquid copper, the amount of phosphorous copper added in the liquid copper also needs to be controlled. By detecting the incremental amount of the liquid copper in the refining furnace within a unit time, the amount of phosphorous copper in need within the unit time may be known, such that when a change of the amount of the liquid copper is detected, the amount of phosphorous copper may also change; in this way, the phosphorous content in the liquid copper may be well controlled to improve quality of the liquid copper.

Furthermore, the maintaining the reducing atmosphere in the vertical shaft furnace comprises: detecting air flow and fuel gas flow introduced into the vertical shaft furnace, respectively; guiding a fraction of the mixed gas into a detecting zone and igniting the fraction; detecting carbon monoxide concentration in a burnt gas; and in response to the carbon monoxide concentration being lower than a preset value, reducing the air flow. By detecting the air flow and the fuel gas flow, the proportion between the air and the fuel gas in the mixed gas may be obtained. The atmosphere in the vertical shaft furnace after the mixed gas enters and reacts in the vertical shaft furnace may be inferred by calculating the proportion, wherein the proportion between the components in the mixed gas may be adjusted to change the atmosphere in the vertical shaft furnace so as to maintain a good oxygen removal environment in the vertical shaft furnace, wherein the products of the ignited mixed gas may be analyzed after igniting the mixed gas. A higher carbon monoxide indicates a better reducing atmosphere in the vertical shaft furnace; however, when the carbon monoxide concentration is lower than a preset value, an excessive oxygen content in the vertical shaft furnace is indicated, which would deteriorate the oxygen removal efficiency and affect production of billets.

These characteristics and advantages of the present disclosure will be disclosed in detail in the embodiments below with reference to the accompanying drawings.

BRIEF DESCRIPTION OF THE DRAWINGS

Hereinafter, the disclosure will be described in further detail with reference to the accompanying drawings.

DESCRIPTION OF THE EMBODIMENTS

Figure 1:
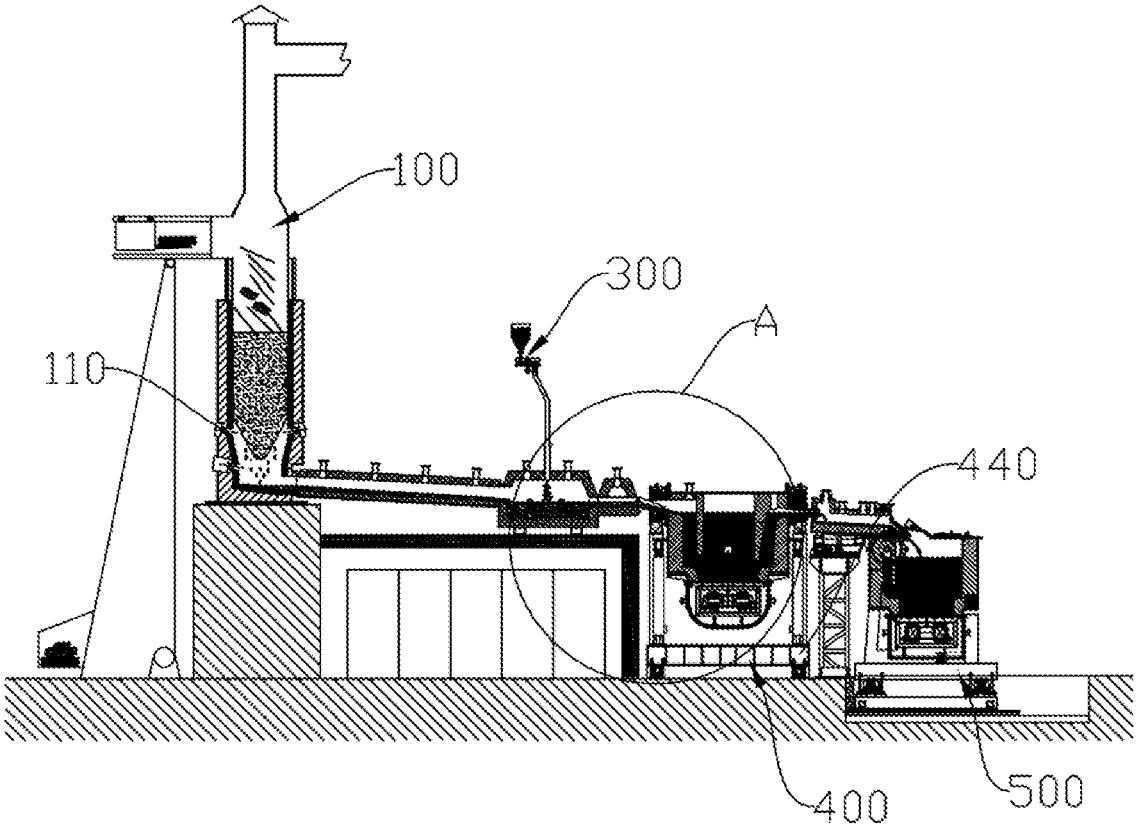
FIG. 1 is a structural schematic diagram of a copper billet horizontal continuous casting apparatus with a vertical shaft furnace for smelting according to an embodiment of the disclosure.

Hereinafter, the technical solutions of the present disclosure will be explained and illustrated through embodiments with reference to the accompanying drawings. However, the embodiments are only some embodiments of the present disclosure, not all of them. Other embodiments obtained by those skilled in the art without exercise of inventive work based on the examples in the embodiments all fall within the protection scope of the present disclosure.

In the description of the present disclosure, it needs to be understood that the orientational or positional relationships indicated by the terms "center," "longitudinal," "transverse," "length," "width," "thickness", "upper," "lower," "front," "rear," "left," "right," "vertical," "horizontal," "top," "bottom," "inner," "clockwise," "counterclockwise," etc. are orientational and positional relationships based on the drawings, which are intended only for facilitating description of the present disclosure and simplifying relevant illustrations, not for indicating or implying that the devices or elements have to possess such specific orientations and have to be configured and operated with such specific orientations; therefore, they should not be construed as limitations to the present disclosure.

Besides, the terms "first" and "second" are only used for descriptive purposes, which shall not be construed as indicating or implying a relative priority or implicitly indicating the number of technical features as indicated. Therefore, the features limited by "first" and "second" may explicitly or implicitly include one or more of such features. In the description of the present disclosure, unless otherwise indicated, "a plurality of" indicates two or above.

In the present disclosure, unless otherwise explicitly provided and limited, the terms such as "mount," "connect," "attach," and "fix" should be understood broadly, which, for example, may refer to a secured connection, a detachable connection, or an integral connection; which may be a mechanical connection or an electrical connection; which may be a direct connection or an indirect connection via an intermediate medium; which may also be a communication between the insides of two elements. To a person of normal skill in the art, specific meanings of the above terms in the present disclosure may be understood based on specific situations.

In the present disclosure, unless otherwise explicitly provided and limited, that a first feature is "above" or "below" a second feature may include a direct contact between the first feature and the second feature or may include a case where although the first feature and the second feature do not contact directly, but they contact via a further feature there between. Moreover, that the first feature is "above" or "over" or "on" the second feature includes a case where the first feature is exactly or generally over the second feature or only indicates that the horizontal height of the first feature is higher than the second feature. That the first feature is "under" or "below" or "beneath" the second feature includes a case where the first feature is exactly or generally below the second feature or only indicates that the horizontal height of the first feature is lower than the second feature.

Referring to FIG. 1 to FIG. 4, embodiments of the disclosure provide a copper billet horizontal continuous casting apparatus with a vertical shaft furnace for smelting, which may implement multi-strand casting with ensured quality.

The copper billet horizontal continuous casting apparatus with a vertical shaft furnace for smelting comprises: a vertical shaft furnace 100 for melting copper; and a mixing furnace 200 connected with the vertical shaft furnace 100 and a phosphorous copper charger 300, for mixing liquid copper and phosphorous copper; and a refining furnace 400 connected with the mixing furnace 200, for refining the liquid copper; and a holding furnace 500 connected with the refining furnace 400, for continued slag removal; and a continuous casting furnace 600 connected with the holding furnace 500, for simultaneously casting multiple strands of billets.

The copper billet horizontal continuous casting apparatus with a vertical shaft furnace for smelting according to the disclosure uses the vertical shaft furnace 100 for melting copper, which may produce a large amount of liquid copper to satisfy liquid copper demand of multi-strand casting, wherein the phosphorous copper is utilized to remove oxygen and impurities from the liquid copper. After removal of oxygen and impurities with the phosphorous copper, continued removal of impurities may yield high-quality liquid copper; meanwhile, the large amount of liquid copper enables smooth implementation of high-quality, multi-strand casting, which improves production speed of tube blanks and reduces production cycle.

Manufacturing of tube blanks by the disclosed copper billet horizontal continuous casting apparatus with a vertical shaft furnace for smelting comprises steps of:

- S10: introducing a mixed gas including air and a fuel gas into the vertical shaft furnace, and maintaining a reducing atmosphere in the vertical shaft furnace;
- S20: igniting the mixed gas to melt copper such that liquid copper flows into a mixing furnace, feeding, by a phosphorous copper charger, phosphorous copper blocks into the mixing furnace, delivering the liquid copper with molten phosphorous copper blocks into the refining furnace and meanwhile measuring weight of the refining furnace to obtain an incremental amount of liquid copper in the refining furnace within a unit time, and adjusting weight of the phosphorous copper charged from the phosphorous copper charger;

S30: introducing an inert gas and/or a reducing gas to a bottom wall of the refining furnace to stir the liquid copper to accelerate slag removal;

S40: delivering the liquid copper at a bottom wall of the refining furnace to a holding furnace, and adding a refining agent (a rare earth material) to the holding furnace to hold the liquid copper;

S50: delivering the liquid copper in the holding furnace into a continuous casting furnace to produce billets, and measure in real time weight of the liquid copper in the holding furnace and weight of outputted copper liquid.

The ignited mixed gas may heat the copper in the vertical shaft furnace 100. The main components of the mixed gas include air and a fuel gas, wherein the air contains oxygen and a large amount of nitrogen; and the main compositions of the fuel gas are hydrogen element and carbon element. Reaction between the fuel gas and the oxygen may produce a carbon oxide including carbon monoxide and carbon dioxide, wherein the carbon monoxide has a good reducibility which may react with the oxygen in the liquid copper, thereby achieving an effect of oxygen removal. Maintaining of a reducing atmosphere in the vertical shaft furnace 100 may effectively reduce the oxygen content in the liquid copper and improve quality of the liquid copper. Meanwhile, reaction between the fuel gas and the oxygen produces hydrogen that is dissolved in the liquid copper.

The phosphorous copper fed into the mixing furnace 200 is melted by and mixed with the liquid copper before entering the refining furnace 400. Introducing of the inert gas and/or the reducing gas into the refining furnace 400 may stir the liquid copper through the gas, causing the liquid copper and the phosphorous copper to be sufficiently mixed and reacted, which improves oxygen removal efficiency and realizes automatic stirring without manual involvement. Moreover, the gases rise up in the liquid copper, which may quickly carry impurities to the surface of the liquid copper. Since the liquid copper has a larger specific gravity, the impurities carried to the surface by the gases are not further sunk; besides, the gases assume a bubble form in the liquid copper, such that subjected to high temperature and high pressure inside the liquid copper, when the bubbles are rising up in the liquid copper, the liquid copper may force the hydrogen dissolved in the liquid copper resulting from burning of the mixed gas into the bubbles, which may further reduce the hydrogen content in the liquid copper, thereby avoiding occurrence of bubbles on the tube blank surface due to precipitation of hydrogen during the casting and forming process.

To reduce phosphorous content in the liquid copper, the amount of phosphorous copper added to the liquid copper needs also to be controlled. By detecting the incremental amount of the liquid copper in the refining furnace 400 within a unit time, the amount of phosphorous copper in demand within the unit time may be known; when it is detected that the amount of liquid copper changes, the amount of phosphorous copper may also change therewith, such that the phosphorous content in the liquid copper may be well controlled, which improves quality of liquid copper.

During the process of liquid copper production and the process of tube blank casting, by observing the amount of liquid copper in the holding furnace 500, a stable supply of clean, high-quality liquid copper to the continuous casting furnace 600 may be ensured, thereby ensuring quality of the tube blank.

Due to the characteristics of the vertical shaft furnace 100, a long-time blowing of air into the vertical shaft furnace 100 is needed before service, such that a considerable content of oxygen is existent in the vertical shaft furnace 100, which will affect quality of the liquid copper. To ensure quality of the copper liquid, the most important thing is to reduce oxygen content in the liquid copper. If oxygen removal were carried out in subsequent steps, the whole production cycle would be prolonged, which affects production efficiency. Therefore, if a reducing atmosphere in the vertical shaft furnace 100 can be maintained, the oxygen content in the liquid copper can be reduced during melting of the copper blocks into liquid copper, which improves productivity of the overall process.

Specifically, the maintaining the reducing atmosphere in the vertical shaft furnace 100 comprises: detecting air flow introduced in the vertical shaft furnace 100; detecting fuel gas flow introduced in the vertical shaft furnace 100; and measuring and adjusting the proportion between components in the mixed gas.

Reaction between the oxygen and the fuel gas may produce carbon monoxide and carbon dioxide. When the oxygen amount is insufficient, more carbon monoxide is produced, such that a reducing atmosphere is present in the vertical shaft furnace 100. By detecting the air flow and fuel gas flow, the proportion between the air and the fuel gas in the mixed gas may be obtained, wherein the atmosphere in the vertical shaft furnace 100 after the mixed gas enters and reacts in the vertical shaft furnace 100 may be inferred by calculating the proportion, wherein the proportion between the components in the mixed gas may be adjusted to change the atmosphere in the vertical shaft furnace 100 so as to maintain a good oxygen removal environment in the vertical shaft furnace 100, causing the oxygen content in the liquid copper in the vertical shaft furnace 100 less than 100 ppm.

The measuring and adjusting the proportion between components in the mixed gas comprises: guiding a fraction of the mixed gas into a detecting zone and igniting the fraction; detecting carbon monoxide concentration in a burnt gas; and in response to the carbon monoxide concentration being lower than a preset value, reducing the air flow. Once the mixed gas is ignited, an analysis of the products of the burnt gas may start. A higher carbon monoxide indicates a better reducing atmosphere in the vertical shaft furnace 100; however, when the carbon monoxide concentration is lower than a preset value, an excessive oxygen content in the vertical shaft furnace 100 is indicated, which would deteriorate the oxygen removal efficiency and affect production of tube blanks. Naturally, if the concentration of carbon monoxide is overly high, the concentration of hydrogen will be higher accordingly. Although hydrogen does not have an impact on the quality of tube blanks as high as oxygen, too much hydrogen will be precipitated during the casting process, causing bubbles on the surface of the tube blanks, which still has an impact on the quality of tube blanks. Therefore, if the concentration of carbon monoxide is too high, the proportion of air needs to increase.

Specifically, a gas inlet device is provided on the vertical shaft furnace 100. A detecting device (not shown) and an adjusting device (not shown), which are connected with the gas inlet device, are further provided on the vertical shaft furnace 100. The detecting device is configured for detecting a proportion between the components in the mixed gas so as to control the adjusting device to adjust the proportion between the components in the mixed gas.

The gas inlet device comprises a plurality of gas inlets 110 arranged on the vertical shaft furnace 100 along the vertical direction. The plurality of gas inlets 110 enable the mixed gas to be introduced to various portions in the vertical shaft furnace 100, thereby maintaining temperature uniformity in the vertical shaft furnace 100 and improving smelting efficiency.

The gas inlet device further comprises a fuel gas pipe and an air flushing pipe, which are connected to the gas inlets 110, wherein the fuel gas pipe is configured for introducing fuel gas, and the air flushing pipe is configured for blowing air in. The adjusting device comprises a gas inlet pipe connected with the gas inlets 110, and gas inlet valves disposed at the gas pipe and the air flushing pipe. The detecting device is connected with the gas inlet pipe so as to access the mixed gas at the gas inlets 110 via the gas inlet pipe to detect a proportion between components of the mixed gas. The gas inlet valves may adjust the flow of the fuel gas or the flow of air, maintaining the mixed gas at an appropriate proportion between the components, thereby ensuring quality of the liquid copper.

Figure 2:
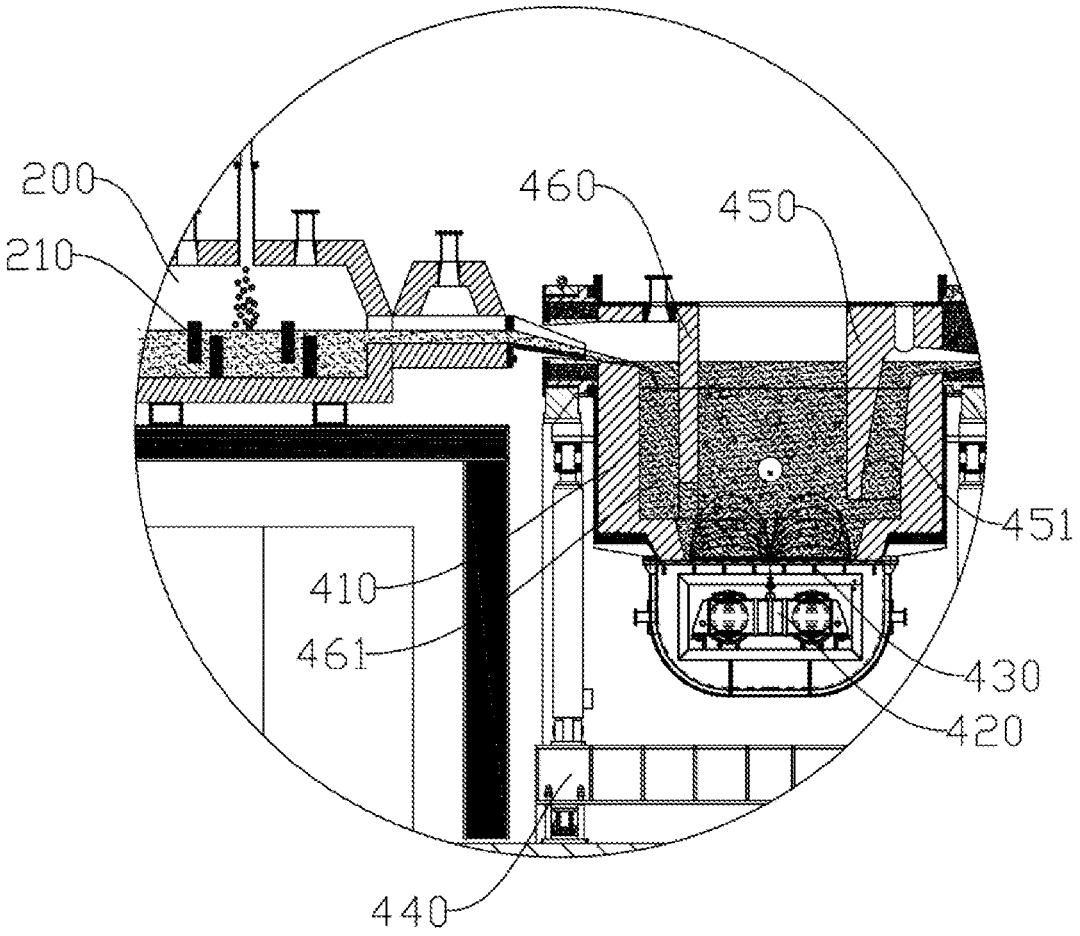
FIG. 2 is an enlarged view of part A in FIG. 1.

Referring to FIG. 2, based on the embodiments above, in a further embodiment of the disclosure, the refining furnace 400 comprises a furnace body 410 and a gas flushing device 420 disposed beneath the furnace body 410, and a gas flushing brick 430 is provided at the chamber bottom wall of the furnace body 410.

The gas flushing device 420 may blow out an inert gas and/or a reducing gas. The gas flushing brick 430 has dense and very fine holes. The gas blown from the gas flushing device 420 may pass through the gas flushing brick 430 to enter the furnace body 410, while the liquid copper cannot pass through the gas flushing brick 430. In this way, the copper liquid may be stirred by the gases.

If the flushing gases further include a reducing gas, the oxygen removing speed with respect to the liquid copper may be further accelerated.

During the oxygen removal process in the refining furnace 400, a layer of charcoal may be further provided to cover the surface of the liquid copper. The charcoal may insulate the oxygen from the liquid copper and participate in the redox reaction to reduce the oxygen content in the liquid copper. In addition, the charcoal further has a strong adsorption capability. After the bubbles carry the impurities in the liquid copper to the surface of the liquid copper, the impurities may be adsorbed by the charcoal, which facilitates extraction of the impurities. In the liquid copper, the bubbles gradually rise up to the surface of the liquid copper, which may carry the impurities and hydrogen to the surface of the liquid copper. This not only yields a good impurity removal effect but also avoids the impurities from being suspended below the upper level of the liquid copper, thereby avoiding waste of much liquid copper in the slag extracting process.

In addition, the refining furnace 400 is preferably an electric induction furnace, which applies electromagnetic induction to stir the liquid copper in the furnace and heat the liquid copper to make its temperature rise.

Figure 4:
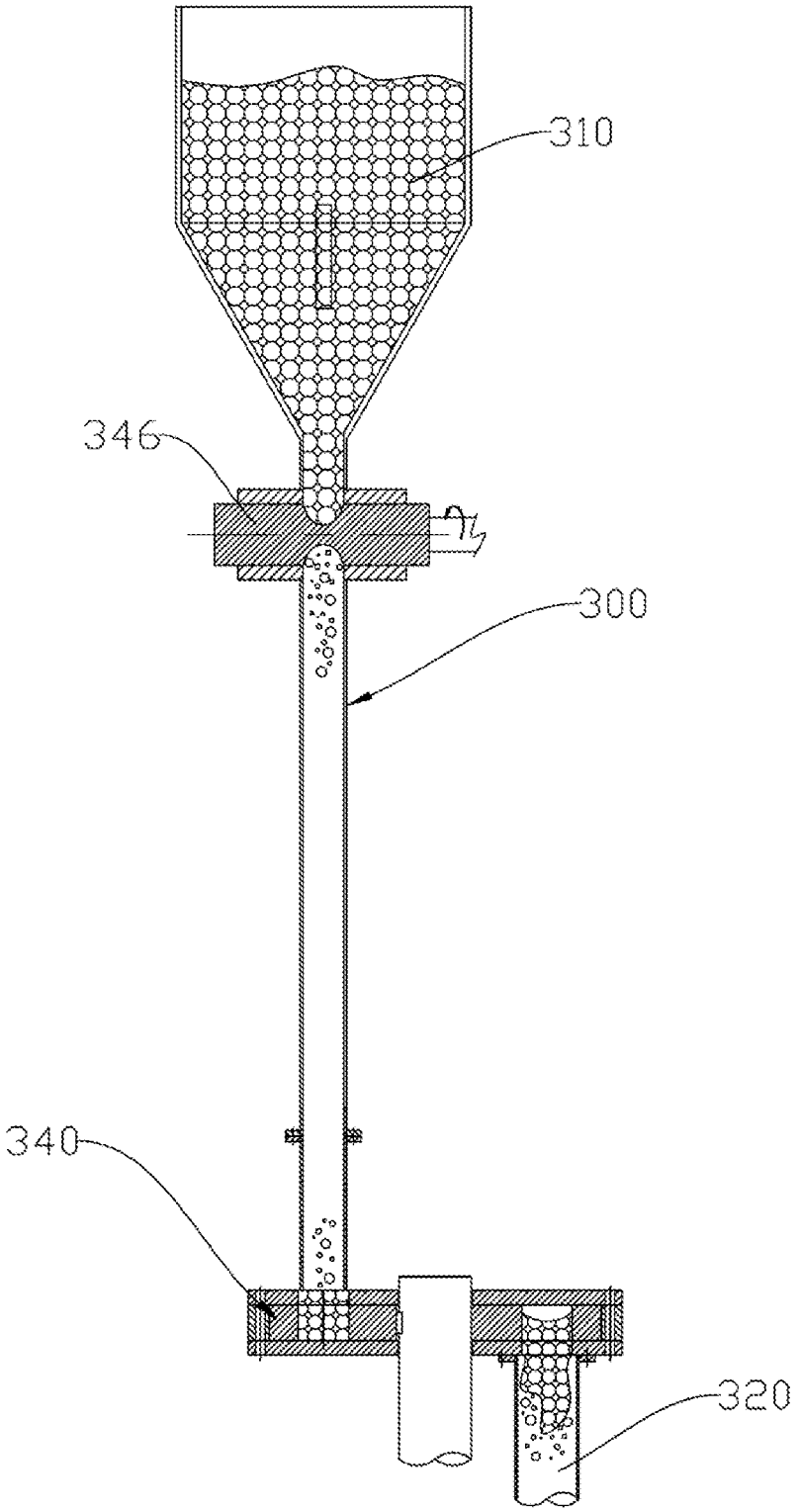
FIG. 4 is a structural schematic diagram of a phosphorous copper charger in an embodiment of the disclosure.
Figure 5:
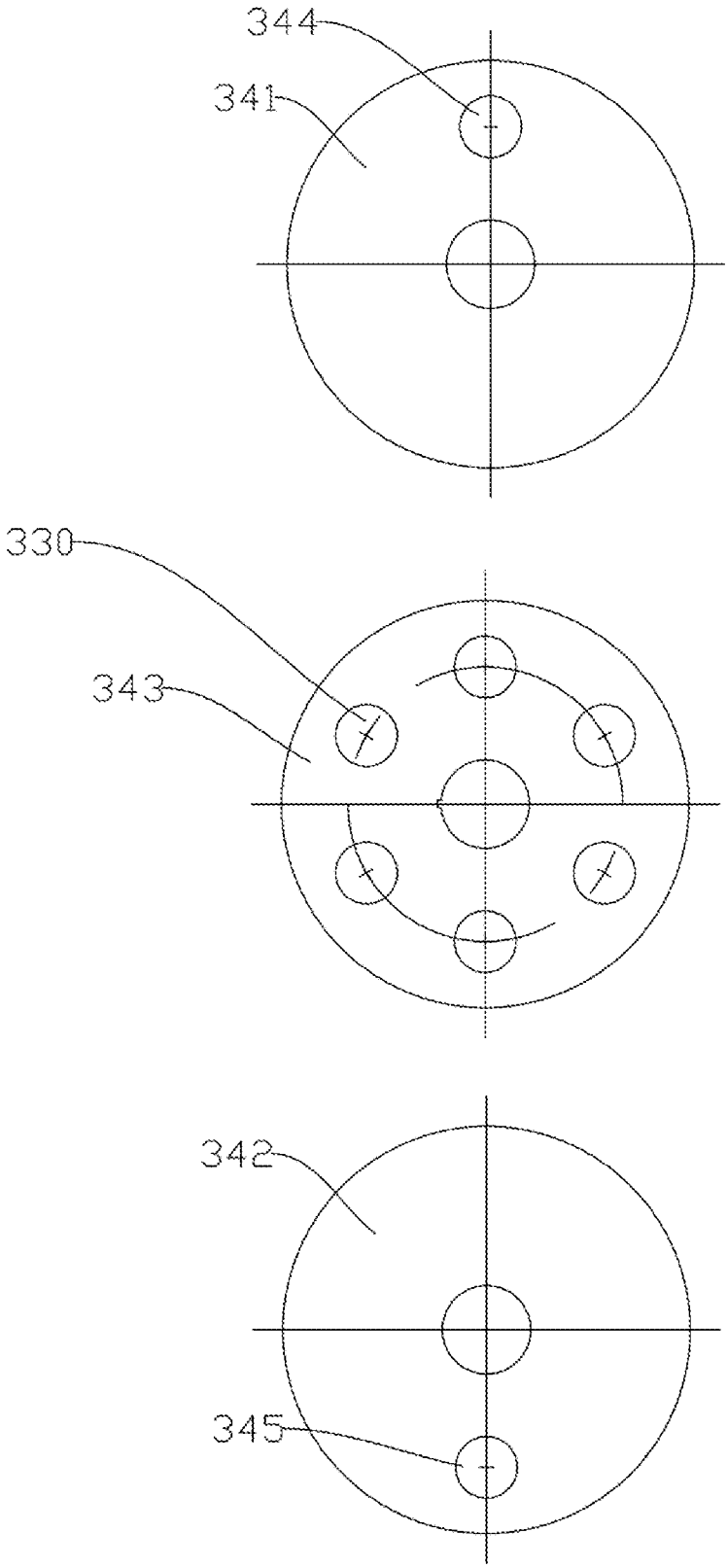
FIG. 5 is a plane view of various parts of a rotary bowl feeder in an embodiment of the disclosure.

Referring to FIG. 2, FIG. 4, and FIG. 5, based on the embodiments above, in another embodiment of the disclosure, the refining furnace 400 further comprises a weighing appliance 440 for measuring weight of the furnace body 410. By collecting the data regarding the weight of the furnace body 410, weight change (i.e., change amount of the liquid copper) of the furnace body 410 within a unit time may be obtained; meanwhile, by measuring the weight of the holding furnace 500, the amount of the liquid copper fed from the mixing furnace 200 into the refining furnace 400 within the unit time may be obtained. In this way, the charging amount of the phosphorous copper from the phosphorous copper charger 300 may be adjusted to maintain an optimal proportion between the phosphorous copper and the liquid copper, which may not only enable sufficient oxygen removal, but also may prevent excessive phosphorous content in the liquid copper. Meanwhile, by detecting the weight of the holding furnace 500, the change amount of the liquid copper in the holding furnace 500 within the unit time may be obtained to adjust the amount of refining agent to be added.

In an embodiment, the phosphorous copper charger 300 may automatically adjust the amount of the phosphorous copper to be added. Specifically, the phosphorous copper charger 300 comprises a hopper 310, and a delivery passageway 320 connected with the phosphorous copper charging port on the mixing furnace 200, wherein a rotary bowl feeder 340 having a plurality of phosphorous copper holding zones 330 is disposed between the hopper 310 and the delivery passageway 320. The rotary bowl feeder 340 comprises a first fixed bowl 341, a second fixed bowl 342, and a rotary bowl 343 rotatably mounted between the first fixed bowl 341 and the second fixed bowl 342; a feeding port 344 connected with the hopper 310 is provided on the first fixed bowl 341, and a delivery port 345 connected with the delivery passageway 320 is provided on the second fixed bowl 342. When the rotary bowl 343 rotates till the phosphorous copper holding zones 330 lie beneath the feeding port 344, the phosphorous copper in the hopper 310 may enter the phosphorous copper holding zones 330; when the rotary bowl 343 rotates till the phosphorous copper holding zones 330 lie at the delivery port 345, the phosphorous copper in the phosphorous copper holding zones 330 may enter the delivery passageway 320.

By adjusting the rotating speed of the rotary bowl 343, duration of charging the phosphorous copper to the liquid copper may be controlled, and the amount of phosphorus copper fed into the phosphorous copper holding zones 330 may also be adjusted so as to change the proportion between the liquid copper and the phosphorous copper.

The plurality of phosphorous copper holding zones 330 are disposed on the rotary bowl 343 in a rectangular array. The orderly arrayed phosphorous copper holding zones 330 may facilitate control of the rotating speed and rotating angle of the rotary bowl 343.

To facilitate control, a weighing appliance is further provided in each phosphorous copper holding zone 330, and an electromagnetic switch 346 for controlling the phosphorous copper to enter the phosphorous copper holding zones 330 is disposed beneath the hopper 310. Since the phosphorous copper blocks are of non-uniform sizes, the amount of the phosphorous copper cannot be determined based on the space taken up by the phosphorous copper in the phosphorous copper holding zones 330, while the weighing appliance may measure the amount of phosphorous copper in each phosphorous copper holding zone 330, thereby controlling the charging amount of the phosphorous copper based on the amount of copper liquid in the mixing furnace 200, which may avoid excessive phosphorous content in the liquid copper.

The step S20 of adjusting the weight of the phosphorous copper charged from the phosphorous copper charger comprises:

inferring the flow of liquid copper in the mixing furnace based on an incremental amount of the liquid copper in the refining furnace within a unit time;

calculating the weight of the phosphorous copper in demand based on the flow of the liquid copper;

measuring, by the rotary bowl feeder, weight of the received phosphorous copper, and switching off the electromagnetic switch after the weight of the phosphorous copper reaches a preset value.

Referring to FIG. 2, to further improve quality of the tube blank and ensure cleanness degree of the liquid copper, in another embodiment of the disclosure, a first baffle 450 is provided at a side in the refining furnace 400 proximal to the holding furnace 500, the first baffle 450 and an inner wall of the refining furnace 400 enclose a liquid copper output zone 451 with a bottom opening, wherein the liquid copper output zone 451 is connected with the liquid copper inlet port of the holding furnace 500.

The liquid copper in the refining furnace 400 still has impurities such as oxygen and hydrogen. The first baffle 450 may directly block the liquid copper entering the refining furnace 400 from the mixing furnace 200. The flowing liquid copper is first stirred by the gases for sufficient removal of impurities; therefore, the lower-layer liquid copper proximal to the holding furnace 500 is relatively clean. To cast tube blanks with this fraction of liquid copper may ensure quality of the tube blanks.

A second baffle 460 is provided at a side in the refining furnace 400 proximal to the mixing furnace 200. The second baffle 460 and an inner wall of the refining furnace 400 enclose a liquid copper inlet zone 461 with a bottom opening, wherein the inert gas and/or the reducing gas are introduced to the center position of the bottom wall of the refining furnace 400. The second baffle 460 may block the liquid copper entering the holding furnace 500 from the refining furnace 400 from directly flowing till beneath the liquid copper output zone 451; instead, the second baffle 460 may buffer the liquid copper to ensure sufficient removal of the oxygen and impurities, thereby improving quality of the liquid copper.

With blocking by the first baffle 450 and the second baffle 460, gases introduced into the refining furnace are located in the region between the two baffles, which has no impact on the liquid copper output zone 451 and the liquid copper inlet zone 461, thereby ensuring sufficient removal of oxygen and improving quality of the copper liquid as much as possible.

Figure 3:
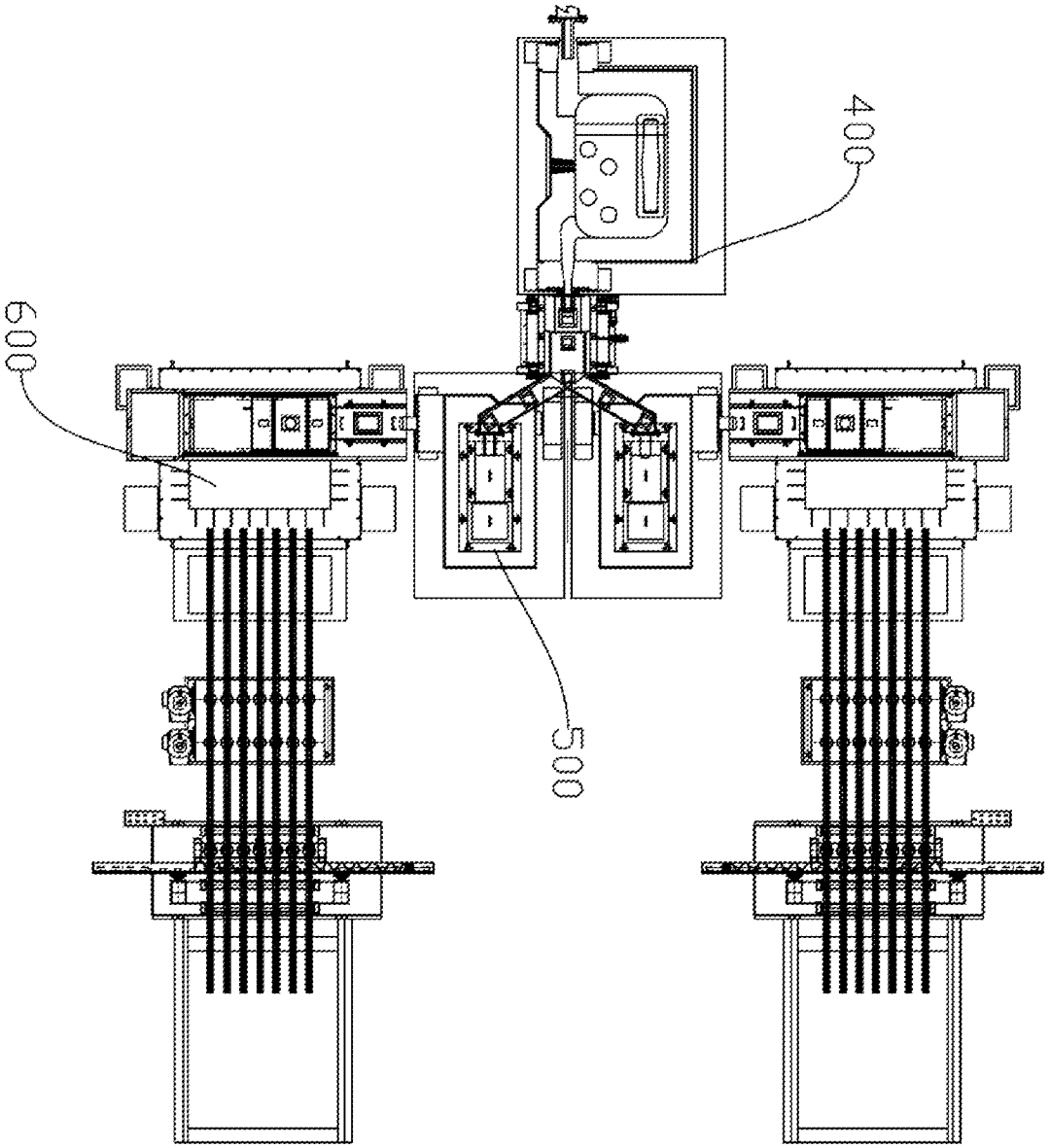
FIG. 3 is a schematic diagram of connecting a continuous casting furnace to a refining furnace and a holding furnace in an embodiment of the disclosure.

Referring to FIG. 3, in another embodiment of the present disclosure, specifically:

The copper billet horizontal continuous casting apparatus with a vertical shaft furnace for smelting comprises two holding furnaces 500, wherein the two holding furnaces 500 are connected with a same refining furnace 400; the two holding furnaces 500 are connected with one continuous casting furnace 600, respectively. Since it takes certain time for each holding furnaces 500 to process the liquid copper, when one holding furnace 500 is processing the liquid copper, the continuous casting furnace 600 connected with the other holding furnace 500 may carry out casting of tube blanks; after casting of the tube blanks is finished, the previous holding furnace 500 also completes processing of the liquid copper; this enables continuous casting of tube blanks. In this way, tube blanks can be produced non-intermittently.

The continuous casting furnace 600 comprises a casting furnace, wherein an integrated crystallizer that may simultaneously cast multiple strands of hollow billets is provided on the front panel of the casting furnace. A double-roller drawing machine that may simultaneously draw multiple strands of billets and a synchronous saw cutting machine are mounted at the front end of the crystallizer, wherein an electric motor drives drawing rollers of the drawing machine to rotate, bringing drawing rods to draw out the liquid copper via the crystallizer to cast hollow billets; the drawing continues, and a process-required length is cut by the in-line synchronous saw cutting machine. The continuous casting furnace in the disclosure enables simultaneous casting of at least five strands of billets. Generally, during the production process, the billets are produced with seven strands at each time.

After being cut, the hollow copper billets are transferred to a weighing platform to be automatically weighed and coded. The weighed, coded hollow billets are transferred to the next procedure.

Referring to FIG. 2, in another embodiment of the disclosure, a plurality of lines of baffles 210 arrayed in an upper-lower spaced manner are provided in the mixing furnace 200, forming a tortuous liquid copper passageway.

Since the copper blocks in the vertical shaft furnace 100 have relatively many impurities and a fraction of the impurities are not melted in the liquid copper, this fraction of impurities may be removed by a physical impurity removal approach. Since a plurality of lines of baffles 210 arrayed in an upper-lower spaced manner are provided in the mixing furnace 200, when the liquid copper flows in the mixing furnace 200, it constantly contacts with the baffles 210; in addition, the liquid copper flow path assumes a shape of up-down fluctuation in the transverse direction, such that a fraction of the impurities in the liquid copper may be blocked by the baffles 210 from further flowing into the refining furnace 400. With cooperation between the multiple baffles 210, impurities not melted in the liquid copper are removed from entering the refining furnace 400.

What have been described above are only embodiments of the present disclosure; however, the protection scope of the present disclosure is not limited thereto. A person skilled in the art should understand that the present disclosure includes, but not limited to the contents described in the drawings or the embodiments. Any modifications without departing from the functions and structural principles of the present disclosure will be included within the scope of the claims.

What is claimed is:

1. A copper billet horizontal continuous casting apparatus with a vertical shaft furnace for smelting, comprising:

the vertical shaft furnace for melting copper;

a refining furnace for refining liquid copper;

a mixing furnace connected with the vertical shaft furnace and the refining furnace, for mixing the liquid copper and phosphorous copper, the mixing furnace has a phosphorous copper charging port, a phosphorous copper charger being connected at the phosphorous copper charging port;

a holding furnace connected with the refining furnace, for continued slag removal; and a continuous casting furnace connected with the holding furnace, for simultaneously casting multiple strands of billets;

wherein the refining furnace comprises a furnace body and a gas flushing device disposed beneath the furnace body, a gas flushing brick being disposed at a chamber bottom wall of the furnace body, the gas flushing device blowing an inert gas and/or a reducing gas into the furnace body through the gas flushing brick, a gas inlet device being provided on the vertical shaft furnace for introducing a mixed gas including air and a fuel gas into the vertical shaft furnace, and a detecting device and an adjusting device being further provided on the vertical shaft furnace, the detecting device and the adjusting device being connected with the gas inlet device, wherein the detecting device is configured for detecting a proportion between components in the mixed gas so as to control the adjusting device to adjust the proportion between the components in the mixed gas, thereby maintaining a reducing atmosphere in the vertical shaft furnace.

2. The copper billet horizontal continuous casting apparatus with the vertical shaft furnace for smelting according to claim 1, wherein the phosphorous copper charger comprises a hopper, and a delivery passageway connected with the phosphorous copper charging port, wherein a rotary bowl feeder having a plurality of phosphorous copper holding zones is provided between the hopper and the delivery passageway.

3. The copper billet horizontal continuous casting apparatus with the vertical shaft furnace for smelting according to claim 2, wherein a plurality of lines of baffles arrayed in an upper-lower spaced manner are provided in the mixing furnace to form a torturous liquid copper passageway.

4. The copper billet horizontal continuous casting apparatus with the vertical shaft furnace for smelting according to claim 2, wherein a first baffle is provided at a side in the refining furnace proximal to the holding furnace, the first baffle and an inner wall of the refining furnace enclosing a liquid copper output zone with a bottom opening, the liquid copper output zone being connected with a liquid copper inlet port of the holding furnace; and a second baffle is provided at a side in the refining furnace proximal to the mixing furnace, the second baffle and the inner wall of the refining furnace enclosing a liquid copper inlet zone with a bottom opening, the inert gas and/or the reducing gas being introduced to a center position of the bottom wall of the refining furnace.

5. The copper billet horizontal continuous casting apparatus with the vertical shaft furnace for smelting according to claim 2, wherein the gas inlet device comprises a plurality of gas inlets arranged along a vertical direction of the vertical shaft furnace, the gas inlets being connected with a fuel gas pipe and an air flushing pipe; the adjusting device comprises a gas inlet pipe connected with the gas inlets, and gas inlet valves disposed at the fuel gas pipe and the air flushing pipe; and the detecting device is connected with the gas inlet pipe.

6. The copper billet horizontal continuous casting apparatus with the vertical shaft furnace for smelting according to claim 2, wherein two holding furnaces are provided, the two holding furnaces being connected to the same refining furnace, and the two holding furnaces being connected to one continuous casting furnace, respectively.

7. The copper billet horizontal continuous casting apparatus with the vertical shaft furnace for smelting according to claim 2, wherein the rotary bowl feeder comprises a first fixed bowl, a second fixed bowl, and a rotary bowl rotatably mounted between the first fixed bowl and the second fixed bowl, a feeding port connected with the hopper being provided on the first fixed bowl, a delivery port connected with the delivery passageway being provided on the second fixed bowl, wherein the plurality of phosphorous copper holding zones are arranged on the rotary bowl in a rectangular array.

8. The copper billet horizontal continuous casting apparatus with the vertical shaft furnace for smelting according to claim 7, wherein a plurality of lines of baffles arrayed in an upper-lower spaced manner are provided in the mixing furnace to form a torturous liquid copper passageway.

9. The copper billet horizontal continuous casting apparatus with the vertical shaft furnace for smelting according to claim 7, wherein a first baffle is provided at a side in the refining furnace proximal to the holding furnace, the first baffle and an inner wall of the refining furnace enclosing a liquid copper output zone with a bottom opening, the liquid copper output zone being connected with a liquid copper inlet port of the holding furnace; and a second baffle is provided at a side in the refining furnace proximal to the mixing furnace, the second baffle and the inner wall of the refining furnace enclosing a liquid copper inlet zone with a bottom opening, the inert gas and/or the reducing gas being introduced to a center position of the bottom wall of the refining furnace.

10. The copper billet horizontal continuous casting apparatus with the vertical shaft furnace for smelting according to claim 7, wherein the gas inlet device comprises a plurality of gas inlets arranged along a vertical direction of the vertical shaft furnace, the gas inlets being connected with a fuel gas pipe and an air flushing pipe; the adjusting device comprises a gas inlet pipe connected with the gas inlets, and gas inlet valves disposed at the fuel gas pipe and the air flushing pipe; and the detecting device is connected with the gas inlet pipe.

11. The copper billet horizontal continuous casting apparatus with the vertical shaft furnace for smelting according to claim 7, wherein each phosphorous copper holding zone is provided with a weighing appliance, and an electromagnetic switch for controlling the phosphorous copper to enter the phosphorous copper holding zones is disposed beneath the hopper.

12. The copper billet horizontal continuous casting apparatus with the vertical shaft furnace for smelting according to claim 11, wherein a plurality of lines of baffles arrayed in an upper-lower spaced manner are provided in the mixing furnace to form a torturous liquid copper passageway.

13. The copper billet horizontal continuous casting apparatus with the vertical shaft furnace for smelting according to claim 11, wherein a first baffle is provided at a side in the refining furnace proximal to the holding furnace, the first baffle and an inner wall of the refining furnace enclosing a liquid copper output zone with a bottom opening, the liquid copper output zone being connected with a liquid copper inlet port of the holding furnace; and a second baffle is provided at a side in the refining furnace proximal to the mixing furnace, the second baffle and the inner wall of the refining furnace enclosing a liquid copper inlet zone with a bottom opening, the inert gas and/or the reducing gas being introduced to a center position of the bottom wall of the refining furnace.

14. The copper billet horizontal continuous casting apparatus with the vertical shaft furnace for smelting according to claim 11, wherein the gas inlet device comprises a plurality of gas inlets arranged along a vertical direction of the vertical shaft furnace, the gas inlets being connected with a fuel gas pipe and an air flushing pipe; the adjusting device comprises a gas inlet pipe connected with the gas inlets, and gas inlet valves disposed at the fuel gas pipe and the air flushing pipe; and the detecting device is connected with the gas inlet pipe.

15. The copper billet horizontal continuous casting apparatus with the vertical shaft furnace for smelting according to claim 1, wherein a plurality of lines of baffles arrayed in an upper-lower spaced manner are provided in the mixing furnace to form a torturous liquid copper passageway.

16. The copper billet horizontal continuous casting apparatus with the vertical shaft furnace for smelting according to claim 1, wherein a first baffle is provided at a side in the refining furnace proximal to the holding furnace, the first baffle and an inner wall of the refining furnace enclosing a liquid copper output zone with a bottom opening, the liquid copper output zone being connected with a liquid copper inlet port of the holding furnace; and a second baffle is provided at a side in the refining furnace proximal to the mixing furnace, the second baffle and the inner wall of the refining furnace enclosing a liquid copper inlet zone with a bottom opening, the inert gas and/or the reducing gas being introduced to a center position of the bottom wall of the refining furnace.

17. The copper billet horizontal continuous casting apparatus with the vertical shaft furnace for smelting according to claim 1, wherein the gas inlet device comprises a plurality of gas inlets arranged along a vertical direction of the vertical shaft furnace, the gas inlets being connected with a fuel gas pipe and an air flushing pipe; the adjusting device comprises a gas inlet pipe connected with the gas inlets, and gas inlet valves disposed at the fuel gas pipe and the air flushing pipe; and the detecting device is connected with the gas inlet pipe.

18. The copper billet horizontal continuous casting apparatus with the vertical shaft furnace for smelting according to claim 1, wherein two holding furnaces are provided, the two holding furnaces being connected to the same refining furnace, and the two holding furnaces being connected to one continuous casting furnace, respectively.

19. A copper billet horizontal continuous casting process with the vertical shaft furnace for smelting, using the copper billet horizontal continuous casting apparatus with the vertical shaft furnace according to claim 1, wherein the process comprises steps of:

S10: introducing the mixed gas including air and the fuel gas into the vertical shaft furnace, and maintaining the reducing atmosphere in the vertical shaft furnace;

S20: igniting the mixed gas to melt copper such that liquid copper flows into the mixing furnace, feeding, by the phosphorous copper charger, phosphorous copper blocks into the mixing furnace, delivering the liquid copper with molten phosphorous copper blocks into the refining furnace and meanwhile measuring weight of the refining furnace to obtain an incremental amount of liquid copper in the refining furnace within a unit time, and adjusting weight of the phosphorous copper charged from the phosphorous copper charger;

S30: introducing an inert gas and/or a reducing gas to the bottom wall of the refining furnace to stir the liquid copper to accelerate slag removal;

S40: delivering the liquid copper at the bottom wall of the refining furnace to the holding furnace, and adding a refining agent to the holding furnace to hold the liquid copper; and S50: delivering the liquid copper in the holding furnace into the continuous casting furnace to produce the billets.

20. The copper billet horizontal continuous casting process with the vertical shaft furnace for smelting according to claim 19, wherein maintaining the reducing atmosphere in the vertical shaft furnace comprises:

detecting an air flow and a fuel gas flow introduced into the vertical shaft furnace, respectively;

guiding a fraction of the mixed gas into a detecting zone, and igniting the fraction;

detecting a carbon monoxide concentration in a burnt gas; and in response to the carbon monoxide concentration being lower than a preset value, reducing the air flow.

* * * * *